United States Patent [19]

Keltner

[11] 3,999,220

[45] Dec. 28, 1976

[54] AIR-CUSHIONED PROTECTIVE GEAR

[76] Inventor: Raymond O. Keltner, 8900 Pawnee Lane, Leawood, Kans. 66206

[22] Filed: Apr. 22, 1976

[21] Appl. No.: 679,194

[52] U.S. Cl. ..... 2/413; 2/2

[51] Int. Cl.[2] ..... A42B 1/08

[58] Field of Search ..... 2/2, 3 R, 3 A, 3 B, 2/22, 24, 5, 6; 273/65 A–D; 137/223, 225, 230

[56] References Cited

UNITED STATES PATENTS

| | | | |
|---|---|---|---|
| 1,833,708 | 11/1931 | Ford | 2/3 R |
| 3,462,763 | 8/1969 | Schneider | 2/3 R |
| 3,600,714 | 8/1971 | Cade | 2/3 R |
| 3,761,959 | 10/1973 | Dunning | 2/3 R |
| 3,849,801 | 11/1974 | Holt et al. | 2/3 R |

*Primary Examiner*—G. V. Larkin
*Attorney, Agent, or Firm*—D. A. N. Chase

[57] ABSTRACT

Helmets, shoulder pads, thigh pads and other protective equipment employ a cushioning fluid such as a layer of compressed air to protect both the wearer and an opposing player in contact sports. The helmet or other device has outer and inner walls of resilient material spaced apart to form an air chamber. A central plastic shield disposed between the resilient walls imparts shape and rigidity to the device and has multiple perforations to equalize the air pressure throughout the chamber when the walls flex under impact.

9 Claims, 9 Drawing Figures

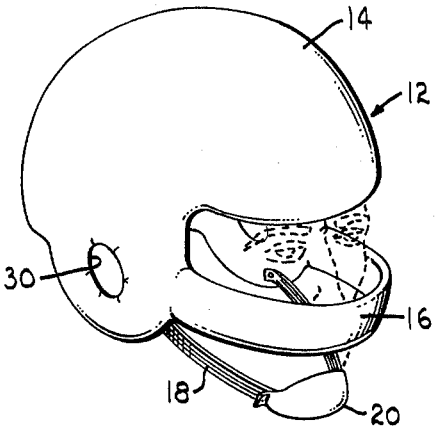
Fig. 1.
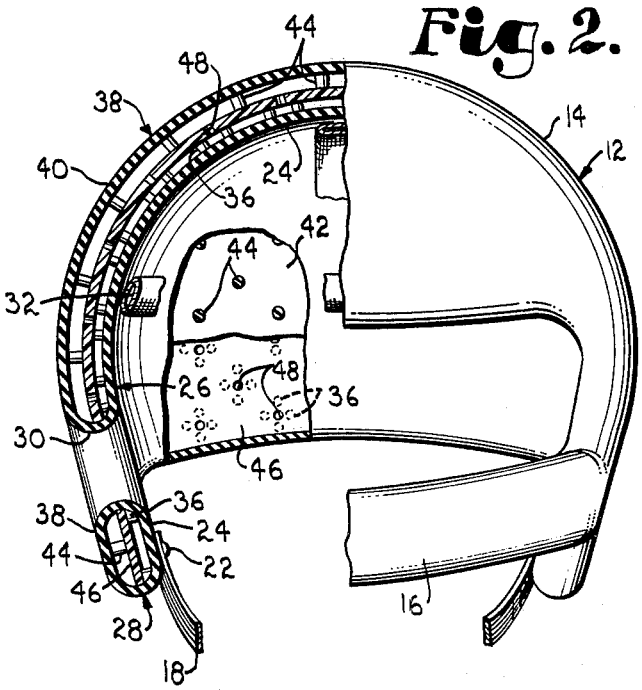
Fig. 2.
Fig. 3.
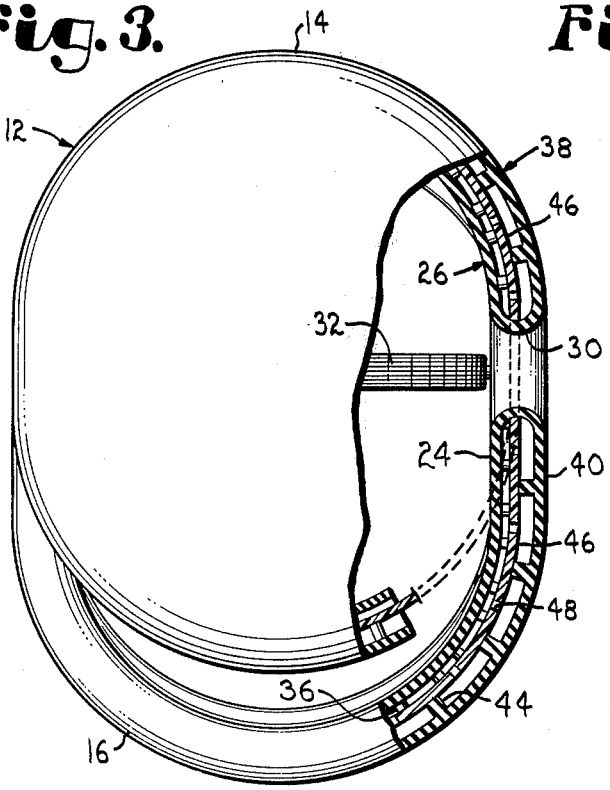
Fig. 4.
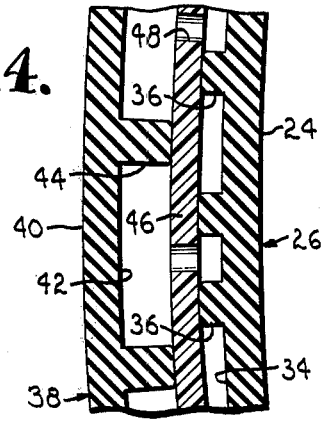
Fig. 5.
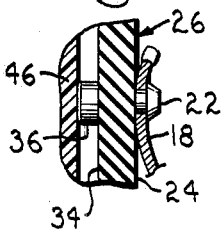

Fig. 6.
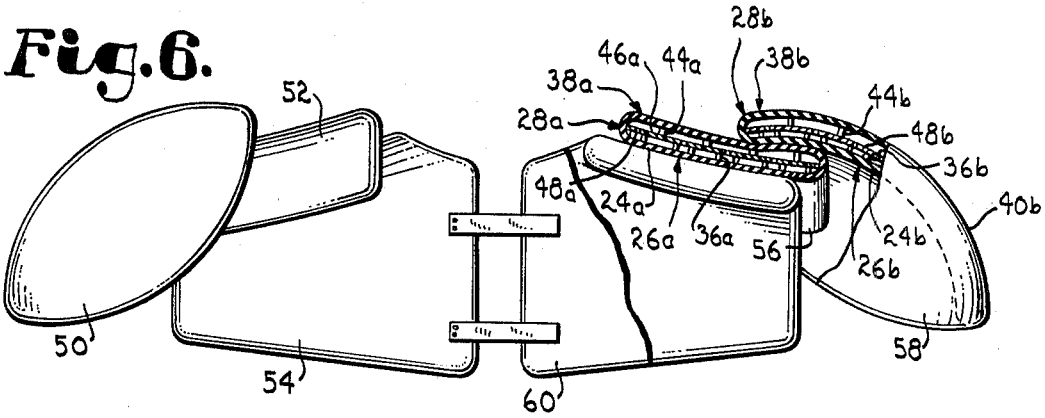
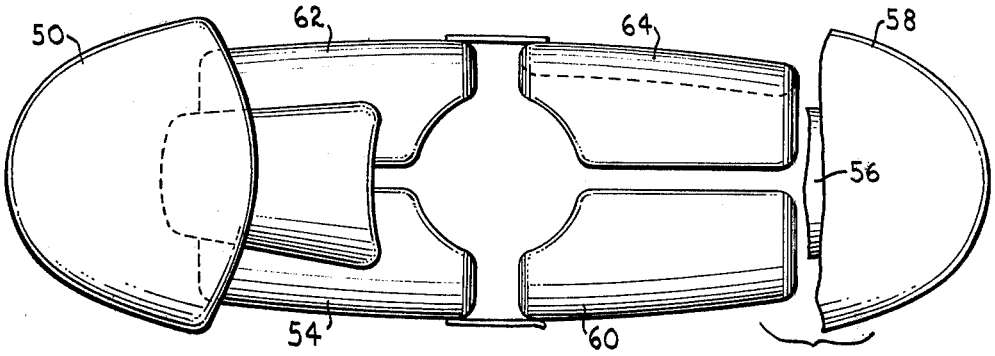
Fig. 7.
Fig. 8.
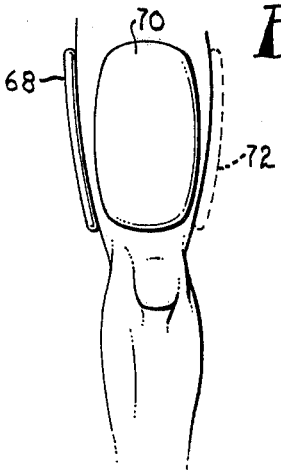
Fig. 9.
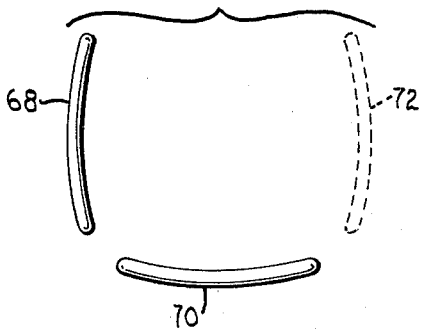

AIR-CUSHIONED PROTECTIVE GEAR

This invention relates to improvements in helmets and other protective equipment worn by participants in football games and other contact sports and, in particular, to improved protective gear wherein both the wearer and the opposing player contacted with the gear are guarded against injury.

Contact sports provide entertainment for participants and fans but their benefit is marred by frequent injuries to players. These injuries may be serious and frequently cause lifelong disability, and are occasionally fatal. Injuries result mainly from collision with opposing players or with the ground after forceful contact with a player. Too often the agent of injury is the hard protective equipment worn by the participant, as his helmet, shoulder pads, and thigh or knee guards can be a lethal weapon. The hard striking surface of protective gear in present use can bring devastating injury or death if it smashes with sufficient force into an unprotected area or at a critical angle.

Although conventional sports equipment is designed to protect the wearer, insufficient consideration is given to the safety of the opposing player. Since opposing players wear the same type of equipment, also with hard striking surfaces, the problem is compounded. Accordingly, I believe that the design and purpose of protective gear should be expanded to protect both the wearer and opponent, and that this goal can be achieved without sacrificing any of the fun or excitement of football or other contact sports.

With the foregoing in view, it is the primary object of the present invention to provide improved protective gear for participants in contact sports or the like wherein both the wearer of the protective gear and the person the wearer comes into contact with are protected from injury.

Another important object of the invention is to provide protective gear as aforesaid which, upon impact, distributes the force over the area of the wearer's body on which such gear is worn.

Still another important object is to provide protective gear as aforesaid in which a cushioning fluid is employed to protect both the wearer and the opposer and distribute the force of impact.

Yet another important object is to provide fluid-cushioned protective gear having resilient contacting surfaces, wherein the fluid (such as a layer of compressed air) is maintained at equal pressure throughout the device regardless of the distortion of the surfaces that will occur upon impact.

Additionally, it is an important object of the invention to provide protective gear as aforesaid that is lighter, less bulky and not as restrictive as equipment presently utilized in contact sports.

Other objects and uses of the present invention will become readily apparent to those skilled in the art upon a perusal of the following specification in light of the accompanying drawings in which:

FIG. 1 is a perspective view of a helmet embodying the present invention;

FIG. 2 is an enlarged, front elevational view of the helmet of FIG. 1 with parts broken away to reveal details of construction.

FIG. 3 is a top plan view of the helmet on the same scale as FIG. 2, parts being broken away to reveal the construction;

FIG. 4 is an enlarged, fragmentary, typical cross-sectional view of the cap structure of the helmet of FIGS. 1–3;

FIG. 5 is a detail view showing the manner in which the chin pad's flexible strapping is secured to the helmet;

FIG. 6 is a frontal view of a set of shoulder pads embodying the invention, parts being broken away to reveal details of construction;

FIG. 7 is a top plan view of the shoulder pads of FIG. 6;

FIG. 8 is a frontal view of a set of thigh pads embodying the invention in place on a wearer; and FIG. 9 is a diagrammatic, top plan view of the thigh pads of FIG. 8.

The helmet 12 shown in FIGS. 1–5 embodies one application of the present invention and comprises a cap 14 and face guard 16, both components being integral parts of the unitary construction employed. Alternatively, the face guard 16 may be separate from the cap 14 and detachable (not shown), but in either form it spreads the impact of blows to the face guard 16 throughout the cap 14 to decrease the possibilities of neck injuries. Flexible strapping 18, attached to helmet 12, secures a chin pad 20 to the wearer's chin. The chin pad 20 may be of the same construction as the helmet 12, such construction being best illustrated in FIG. 4 and described hereinbelow. Each end of the flexible strapping 18 is fastened to an anchoring post 22 projecting from the exterior surface 24 of the inner wall 26 of the padding material 28 of helmet 12.

A small opening 30 in each side of cap 14 over the ears facilitates hearing and air circulation. The helmet 12 is fitted with inner webbing straps 32 over exterior surface 24 of the inner wall 26 of the padding material 28 comprising cap 14, such straps 32 being next to the wearer's head as in most present helmets to provide additional protection, promote air circulation and reduce perspiration.

The inner wall 26 of padding material 28 has an outwardly facing, interior surface 34 (opposing the inwardly facing exterior surface 24) from which a number of short studs 36 project. The outside, exterior surface 40 of material 28 is presented by an outer wall 38 having an inwardly facing, interior surface 42 from which a plurality of longer studs 44 extend. Disposed between the spaced walls 26 and 38 is a rigid, cap-shaped retainer or shield 46 which is preferably made of plastic. The shield 46 has a number of spaced apertures 48 therein for a purpose to be discussed below.

As best shown in FIG. 2, the apertures 48 in shield 46 are arranged in a pattern of laterally spaced rows that extend front to rear over the cap structure. Alternate rows are offset as is clear in FIG. 2. The inwardly extending studs 44 projecting from the interior surface 42 of outer wall 38 are aligned with these rows but are centrally located between adjacent pairs of apertures 48 (compare FIGS. 2 and 4). The outwardly extending studs 36 projecting from the interior surface 34 of the inner wall 26 are arranged in clusters of four around each aperture 48 as shown in phantom lines in FIG. 2. The tips of the studs 36 and 44 are in surface contact with the shield 46 and are secured thereto at their respective areas of contact by a suitable adhesive.

The walls 26 and 38 of the composite padding material 28 are preferably composed of molded rubber or a similar resilient material, with the studs 36 and 44 being formed integral with their respective walls. Alternatively, the studs may be of separate construction and secured to the respective wall surfaces by an adhesive; this would permit the advantageous utilization of softer, foam rubber for the stud material. If a softer material is used for the studs, strands of non-elastic fabric or wire (not shown) may be incorporated into the stud material to limit stretching of the studs. This is to aid in maintaining the concave shape of the inner wall during impact on the outer wall and despite the constant pressure of compressed air between the walls. The air pressure would otherwise tend to push the inner wall inwardly into a distorted shape. The function of the studs 36 and 44 is to maintain the resilient walls 26 and 38 normally spaced from the centrally disposed shield 46, while permitting such walls to flex under impact toward and, to a limited degree, away from the shield.

The interior surfaces 34 and 42 of the respective walls 26 and 38 are united together at the marginal edges of the cap 14 to form a fluid-tight chamber between the walls where a layer of air remains after fabrication. The layer of air is compressed to a degree dependent upon the ultimate use of the helmet, and serves as a cushioning fluid to protect both the wearer and an opposing player struck by the helmet.

More specifically, the amount of air pressure in the chamber between the walls 26 and 38 is selected according to the requirements of a given application in order to provide adequate protection for the wearer. Both the pressure and the bulkiness of the helmet are variables that determine the amount of protection afforded. For example, smaller children such as in grade school football leagues would wear relatively larger helmets with lesser pressures than high school, college or professional players.

The chamber may be pressurized to the desired level at the time of manufacture of the helmet and maintained constantly at such level thereafter because of the air-tight construction of the unit. Alternatively, an air valve (not shown) could be inserted into the helmet wall at the time of fabrication. The chamber could then be pressurized by an air pump and varied as desired.

The central shield 46 imparts the desired shape and rigidity to the helmet 12 in cooperation with the spacer studs 36 and 44 which support the inner and outer walls as discussed above. However, when the wearer makes impactive contact with another player or object, the outer wall 38 is forced to flex inwardly toward the shield 46 and reduce the volume of the air chamber between the walls. Also, depending on the force of impact, the inner wall 26 may flex to a limited degree and the shield 46 may be pushed inwardly somewhat. This volume reduction causes the air pressure in the chamber to increase, but such increased pressure is distributed throughout the padding material 28 by virtue of the apertures 48 that permit free air flow from one side of the shield to the other. Accordingly, the air pressure throughout the chamber is instantaneously equalized so that the impact is not localized but is, instead, distributed over the area of the wearer's body on which the protective gear is worn (over the entire head). Furthermore, the effect of the impact on an opposing player struck by the helmet 12 is minimized by the yieldable nature of the outer wall 38 and the force-spreading action of the air cushion.

These same principles apply to the other forms of protective equipment illustrated in FIGS. 6–9. Referring first to FIGS. 6 and 7, the shoulder pads are composed of separate components each containing its own chamber filled with cushioning fluid. Except for the shape, the internal construction of each component is identical to that as shown in FIGS. 2–4 for the helmet 12; therefore, the internal construction is denoted with the same reference numerals with the addition of the *a* notation for the padding material 28*a* of a left collarbone protector 56. Similarly, the construction of the left shoulder protector 58 is denoted by the *b* series reference numerals. The other components of the shoulder pads include a right shoulder protector 50, a right collarbone protector 52, right and left upper chest protectors 54 and 60, and upper back guards 62 and 64 for the right and left side respectively.

A set of thigh pads embodying the principles of the present invention is illustrated in FIGS. 8 and 9 and includes an outside pad 68, a front pad 70, and an optional inside pad 72 (shown in phantom lines). Besides the applications illustrated, the teachings of the present invention apply equally well to knee guards and other pad devices used to protect vulnerable areas of the human body. The advantages in all applications to both the wearer and an opponent are the same as discussed above with respect to the helmet 12, plus the construction is inherently light and less bulky and thus any restrictive effect on free movement is minimized.

It is preferred that the individual units comprising the shoulder pads be worn in appropriately shaped pockets or compartments sewn into a lightweight but securely fitting undergarment worn beneath the uniform jersey. This will eliminate straps and other restrictive bindings. Thigh guards and other protective gear would also fit into sewn compartments in uniform pants or underpants. Furthermore, parallel strips of felt or other absorbent material could be spaced at intervals on the inner surfaces of the body protective pads to permit air circulation and cooling.

Having thus described the invention, what is claimed as new and desired to be secured by Letters Patent is:

1. A pad device for protecting a complemental part of the body upon which the device is worn, and for minimizing the damage to those that are struck by the wearer, said device comprising:

a pair of spaced, opposed walls of resilient material defining a fluid-tight chamber therebetween and presenting inner and outer surfaces of the device, a cushioning fluid in said chamber presenting a layer thereof bounded by said walls, a relatively rigid retaining member intermediate said walls and normally spaced therefrom, means for securing said device to said part of the body with said inner surface overlying the same, whereby said outer surface is exposed for impactive contact with objects or other persons, and said retaining member having passage means therein permitting fluid flow therethrough to equalize the fluid pressure throughout said layer when the wearer engages in impactive contact and the walls are forced to flex toward and away from said member.

2. The device as claimed in claim 1, wherein said fluid is compressed air.

3. The device as claimed in claim 1, wherein said retaining member presents a shield provided with a pair of opposed sides facing respective walls, said member having a plurality of spaced-apart apertures therein communicating said sides and presenting said passage means.

4. The device as claimed in claim 3, wherein said retaining member is in closer spaced relationship with the inner wall than with the outer wall.

5. The device as claimed in claim 1, further comprising yieldable spacer means between said retaining member and said walls for normally maintaining the walls and member in spaced relationship.

6. The device as claimed in claim 5, wherein said spacer means comprises a plurality of studs on each of said walls engaging said member.

7. The device as claimed in claim 5, wherein said retaining member presents a shield provided with a pair of opposed sides facing respective walls, said member having a plurality of spaced-apart apertures therein communicating said sides and presenting said passage means, and wherein said spacer means includes a number of studs extending between the inner wall and said member and arranged in clusters about corresponding apertures, said apertures being arranged in a predetermined pattern, and a plurality of studs extending between the outer wall and said member and located in the spaces of said pattern between said apertures.

8. A helmet having protective structure comprising the pad device of claim 1 configured to circumscribe the wearer's head.

9. The helmet as claimed in claim 8, wherein said protective structure includes a cap portion and an integral face guard.

* * * * *